US006618873B2

(12) United States Patent
Mulgrew et al.

(10) Patent No.: US 6,618,873 B2
(45) Date of Patent: Sep. 16, 2003

(54) AUTOMATIC FEED WASTE DISPOSAL TOOL

(75) Inventors: Brian Mulgrew, P.O. Box 6574, Delray Beach, FL (US) 33484; Michael M. Anthony, Coral Springs, FL (US)

(73) Assignee: Brian Mulgrew, Delray Beach, FL (US)

( * ) Notice: Subject to any disclaimer, the term of this patent is extended or adjusted under 35 U.S.C. 154(b) by 0 days.

(21) Appl. No.: 10/051,742

(22) Filed: Jan. 22, 2002

(65) Prior Publication Data

US 2003/0135922 A1 Jul. 24, 2003

(51) Int. Cl.[7] ..... E03D 5/09

(52) U.S. Cl. ..... 4/619; 4/255; 4/256; 4/257; 4/255.05

(58) Field of Search ..... 4/619, 255, 256, 4/257, 255.05; 15/105

(56) References Cited

U.S. PATENT DOCUMENTS

| | | | | | |
|---|---|---|---|---|---|
| 1,140,570 | A | * | 5/1915 | Buckley | 211/105.6 |
| 2,128,217 | A | * | 8/1938 | Anderson | 4/255.02 |
| 3,154,256 | A | * | 10/1964 | Bebinger | 241/46.016 |
| 3,644,943 | A | * | 2/1972 | Parodi fu Leonardo et al. | 4/255.11 |
| 3,952,341 | A | * | 4/1976 | Cain | 4/255.01 |
| 3,994,032 | A | * | 11/1976 | Spickofsky | 4/255.11 |
| 4,034,427 | A | * | 7/1977 | Breznock et al. | 4/255.01 |
| 4,137,578 | A | * | 2/1979 | Felici | 4/654 |
| 4,268,080 | A | | 5/1981 | Lindley | |
| 4,297,761 | A | | 11/1981 | Loos | |
| 4,411,054 | A | | 10/1983 | Zeilenga | |
| 4,745,641 | A | * | 5/1988 | Tash | 4/255.11 |
| 5,177,853 | A | | 1/1993 | Herook | |
| 5,488,749 | A | | 2/1996 | Pearce | |
| 5,584,110 | A | | 12/1996 | Mordoch | |
| 5,664,284 | A | | 9/1997 | Brzoska | |
| 5,685,209 | A | | 11/1997 | Fiedler | |
| 5,921,654 | A | | 7/1999 | Coyle | |
| 6,044,502 | A | | 4/2000 | Fountain | |

* cited by examiner

*Primary Examiner*—Gregory Huson
*Assistant Examiner*—Azy Kokabi
(74) *Attorney, Agent, or Firm*—Oltman, Flynn & Kubler

(57) ABSTRACT

A waste disposer assist tool for automatically feeding waste food contained within the housing of a standard kitchen electric food disposer and for spraying liquid soap. The tool includes a hollow handle and a piston which screw together through a central hole of a flexible plunger. The plunger is held between respective flanges ofthe handle and the piston with the piston slightly protruding from within the plunger. The tool is positioned over the opening of the sink above the garbage disposer with the piston fitted within and in a substantially air-tight seal with the interior of the housing of the disposer unit. The plunger fits in a substantially air-tight seal against the bottom interior of the sink. The slight vacuum created by the outflow of ground food waste and water by the garbage disposer blades below the piston causes the higher ambient pressure against the upper side of the plunger to force the piston downward against he waste food in an automatic feed fashion.

9 Claims, 6 Drawing Sheets

AUTOMATIC FEED WASTE DISPOSAL TOOL

BACKGROUND OF THE INVENTION

1. Field of Invention

The present invention relates to devices for manipulating food waste in and around sink mounted garbage disposer units, and more particularly to devices for feeding the food waste into the garbage disposer unit.

2. Description of Related Art

Garbage disposers which mount below the drain outlet of sinks for grinding up food waste are common in today's modern kitchen. Such waste food might include waste food from food preparation such as potato peelings, trimmed fat from meat, and carrot tops, or waste food left over from the meal on the dinner plates. Such uneaten food waste is typically pushed through the drain outlet into the housing of the garbage disposer for grinding using a sponge, dish rag, or sometimes even using one's own hands.

The food waste is fed to the rotatable blades at the bottom of the housing using a flow of water from the sink in conjunction with gravity once the food waste has been pushed into the housing of the garbage disposer. The garbage disposer can be quite slow at times using this method, especially with light weight food waste which tends to form an air pocket above the rotatable blades. Likewise, harder waste food such as bones tends to resist being contacted with the rotatable blades since such contact violently throws the bone away from the blades, sometimes even propelling the bone completely out of the garbage disposer. While pushing down on the food waste can overcome such grinding problems, such can also be very dangerous. If a long spoon or other such kitchen implement is used to manipulate and push the food waste, it can become jammed in the blades or thrown from the garbage disposer. Even worse is the use of one's hands to manipulate and push the food waste, which can possibly contact the blades causing injury. Ideally, the food waste is pushed into the housing of the garbage disposer and the drain opening leading to the housing is covered using a plug prior to starting and during the entire time during which the garbage disposer is being run.

Various devices have been designed for manipulating such food waste from the kitchen sink into the garbage disposer. In U.S. Pat. No. 4,297,761 issued to Loos is disclosed a multi-purpose garbage disposal utensil for sweeping garbage into a garbage disposer. The utensil includes a unitary plug and downwardly disposed blade. The plug prevents the end of the blade from contacting the rotatable blades and plugs the drain hole above a garbage disposer to prevent food waste from exiting the garbage disposer during use. The utensil permits agitating the food waste to speed up and unclog the feed of garbage into a garbage disposer. A problem with the utensil is that while it facilitates rotational and lateral movement of the food waste within the housing of the garbage disposer, the thin vertically disposed blade provides little horizontal surface area for pushing the food waste downwardly towards the rotatable blades for grinding.

Another example of a manual tool for feeding food waste into a garbage disposer is disclosed in U.S. Pat. No. 4,268,080 issued to Lindley. The tool includes a unitary body with a gripping head at one end of the body. A plurality of radially spaced, longitudinally extending ribs extend downwardly from the head whereby the tool may be more easily grasped in-hand. A generally cylindrical shaft also extends downwardly from the head and ribs of such a size as to be insertable into the housing of the garbage disposer. The lower end surface of the shaft includes a pair of horizontally disposed curved surfaces with a central downwardly disposed projection therebetween for manual manipulation of the food waste within the housing of the garbage disposer. The ribs limit the depth to which the shaft of the tool may be inserted in the garbage disposer to prevent contact with the rotatable blades. The tool apparently would allow some pushing of the food waste downwardly due to the larger surface area of the cylindrical shaft. However, the tool still must be manipulated manually and does not have enough surface area to simultaneously contact the entire surface of the food waste in the garbage disposer.

Yet another example of a manual tool for feeding refuse to a garbage disposer, but which also facilitates cleaning of the sink to which the garbage disposer is attached is disclosed in U.S. Pat. No. 5,488,749 issued to Pearce et al. The tool includes a handle having a scraper extending from a first end thereof for scraping food from a surface of the sink. A plunger extends from a second end of the handle for facilitating positioning of food debris into the garbage disposer. A projection extends from the end of the plunger to aid in preventing the plunger from contacting the rotating blades of the garbage disposer. The tool still must be manipulated manually and does not have enough surface area to simultaneously contact the entire surface of the food waste in the garbage disposer.

There is a need for a tool for use with a sink mounted garbage disposer which automatically feeds the food waste within a garbage disposer to the rotating blades for grinding.

SUMMARY OF INVENTION

1. Advantages of the Invention

One of the advantages of the present invention is that it utilizes the slight vacuum created by a garbage disposer while grinding and disposing food waste to automatically feed the food waste contained within the garbage disposer to the rotating blades for grinding.

A further advantage of the present invention is that it stores liquid soap and automatically sprays a predetermined amount of the liquid soap into the garbage disposer while feeding the waste food.

Another advantage of the present invention is its ability to act as a conventional plunger to unclog the garbage disposer and the drain pipe connected thereto.

Yet another advantage of the present invention is its ability to spray liquid soap independently of feeding food waste by compressing the bellows of the handle.

A further advantage of the present invention is its modular design wherein the handle, the piston member, and the plunger can be designed to fit the particular garbage disposer application.

These and other advantages of the present invention may be realized by reference to the remaining portions of the specification, claims, and abstract.

2. Brief Description of the Invention

The present invention comprises a waste disposal assist tool for pushing food waste through the drain hole of a sink and through the housing of a sink-mounted garbage disposer having a plurality of rotatable blades to chop the food waste into particles and deposit them into a waste drain pipe. The tool includes a resilient plunger having an annular top portion and a downwardly dependent annular side wall terminating in an annular rim adapted to fit and seal around the drain hole of the sink above the garbage disposer, the top portion and side wall defining a plunging chamber. A handle is secured to a top of the top portion, the handle extending vertically upwardly from the plunger and adapted for being grasped and manipulated manually in-hand. A piston member of round cross-section is secured to the handle and to a bottom of the portion, the piston extending vertically downwardly from the plunger opposite the handle. The piston is of a size for inserting through the drain hole of the sink and into the garbage disposer so as to reach most of the volume enclosed within the housing of the garbage disposer when the plunger is compressed against the sink coaxially about the drain hole by manually pushing downwardly on the handle. The piston is adapted for urging food waste through the drain hole and the housing of the garbage disposer for chopping into particles against the plurality of rotatable blades and depositing the particles into the waste drain pipe. The plunger is adapted for plunging to alternately create a pressure above and below ambient to unclog the garbage disposer and the drain pipe.

In a preferred embodiment of the tool, the piston member is of such a size as to closely fit to an inner surface of the housing of the garbage disposer. The outer circumference of the piston member sealingly engages the inner surface of the garbage disposer to form a substantially airtight seal thereagainst. When the garbage disposer is activated, ambient air pressure above the plunger forces the piston member downward toward the rotatable blades due to the below ambient air pressure created by the plurality of rotatable blades chopping the food waste into particles and depositing them into the waste drain pipe. The waste food is pushed against the rotatable blades in an automatic feed fashion. The tool also preferably includes automatic spraying of soap into the garbage disposer.

The above description sets forth, rather broadly, the more important features of the present invention so that the detailed description of the preferred embodiment that follows may be better understood and contributions of the present invention to the art may be better appreciated. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE DRAWINGS

Preferred embodiments of the present invention are shown in the accompanying drawings wherein.

DESCRIPTION OF THE PREFERRED EMBODIMENT

Figure 1:
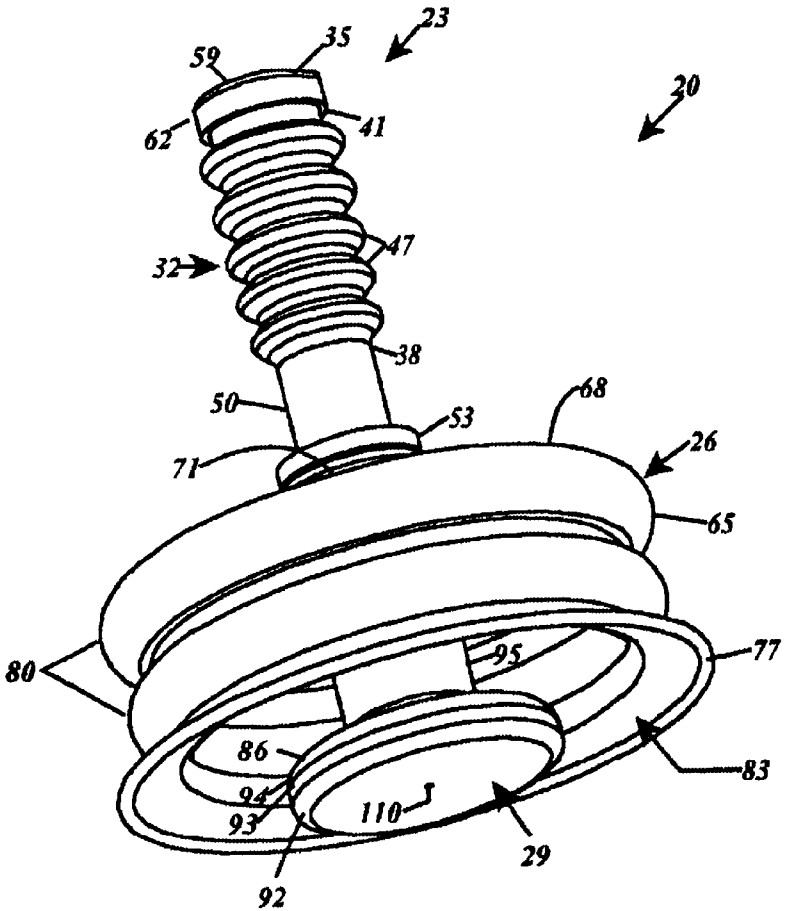
FIG. 1 is substantially a perspective view of a waste disposal assist tool according to the present invention.
Figure 2:
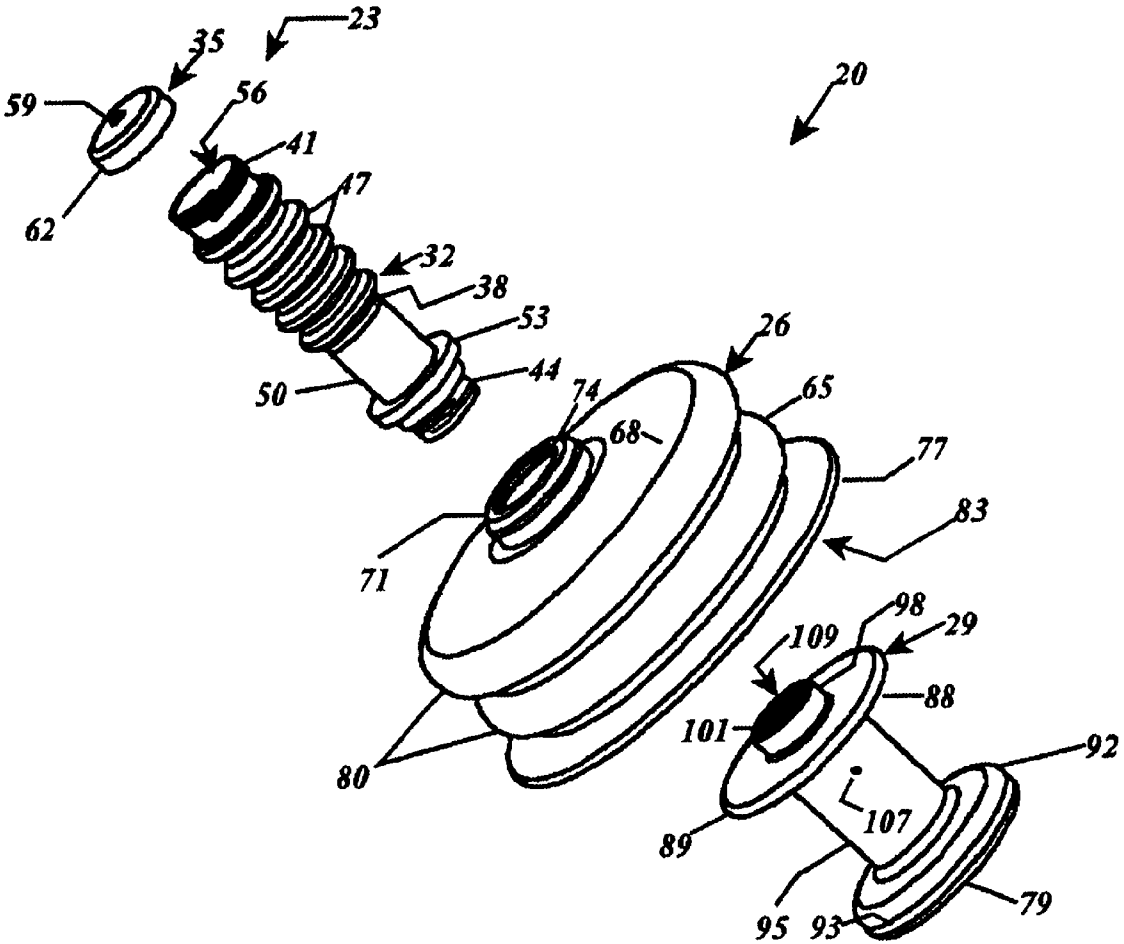
FIG. 2 is substantially an exploded perspective view of the waste disposal assist tool.
Figure 3:
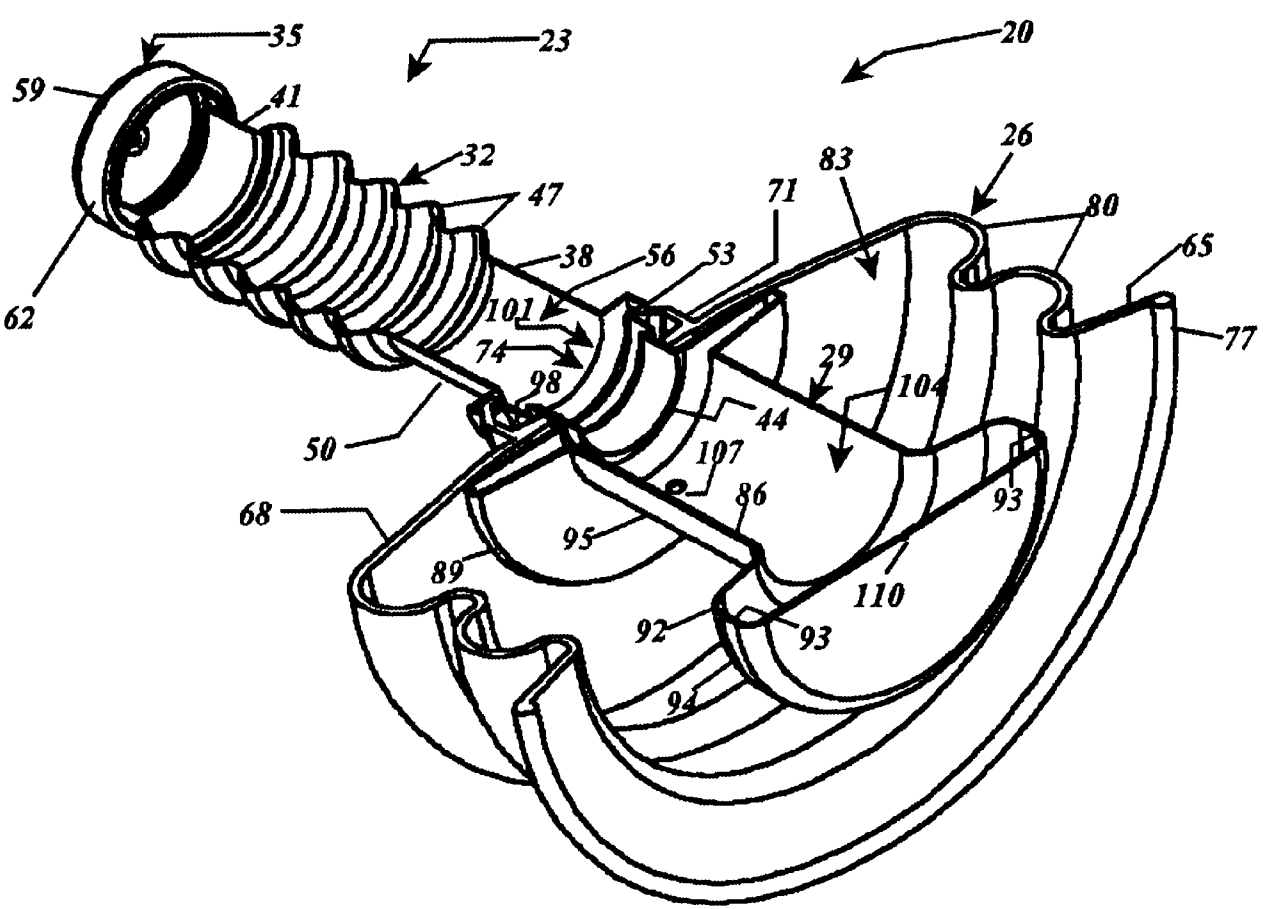
FIG. 3 is substantially a partial longitudinal sectional view of the waste disposal assist tool.

The present invention provides a waste disposal assist tool, generally shown at 20, which comprises a handle assembly 23, a plunger 26, and a piston member 29.

Handle Assembly

The handle assembly 23 includes a thin-walled, hollow handle 32 and a screw cap 35. The handle 32 comprises a single thin annular wall 38 forming respective externally threaded upper and lower ends 41 and 44, a bellows 47, a straight stem 50, and a flange 53 of the handle 32. A reservoir 56 for containing liquid soap (not shown) extends completely longitudinally therethrough. Cap 35 includes a disk 59 and a downwardly dependent annular rim 62 which is internally threaded to threadably engage the upper end 41 of the handle 32. The handle 32 and the cap 35 are made of plastic, such as polyvinyl chloride or polypropylene, with the thickness of the wall 38 being thick enough so as to resist kinking while being used as a handle, but thin enough such that the bellows 47 can be compressed relatively easily by applying hand-pressure. Handle 32 is typically manufactured by a blow molding process to produce a substantially constant thickness for the wall 38 whereas the cap 35 is typically molded by an injection or pressure molding process.

Plunger

The plunger 26 is of a single piece, thin-walled construction, comprising a single thin annular wall 65 forming an upper disk 68 having an upwardly dependent flange 71 with a central hole 74 which extends therethrough, and a lower annular sealing bead 77 interconnected by a bellows 80. A plunging chamber 83 is defined within the plunger 26 by the wall 65. The plunger 26 is made of rubber or plastic, for example polyvinyl chloride or polypropylene, with the thickness of the wall 65 of the plunger 26 being thin enough that the bellows 80 can be compressed relatively easily by applying a slight pressure to the upper disk 68 with the sealing bead 77 retained, but thick enough so as to return to an undeformed shape after releasing the pressure. The plunger 26 is typically manufactured by a blow molding process to produce a substantially constant wall thickness.

Piston Member

Piston member 29 is of a single piece, thin-walled construction, comprising a single thin annular wall 86 forming a generally spool-like configuration with an upper flange 89 and a lower piston 92 interconnected by a stem 95. Piston 92 includes an annular groove 93 at the outer circumference thereof in which an O-ring or a rectangular cross-section sealing ring 94 is disposed. An internally threaded tubular extension 98 extends upwardly from upper flange 89, being of such size as to closely fit within the central hole 74 of the plunger 26. The tubular extension 98 has a hole 101 which extends into a reservoir 104 of the piston member 29 which is internally threaded to threadably engage the externally threaded lower end 44 of the handle 32. An air inlet pin hole 107 extends through the wall 86 at the stem 95 into the reservoir 104. A soap outlet pin hole 110 extends through wall 86 at the lower piston 92 of the stem 95. The piston member 29 is made of plastic, such as polyvinyl chloride, with the wall thickness of the piston member 29 being thick enough so as to act as a piston to push waste without kinking. Piston member 29 is typically manufactured by a blow molding process.

Automatic Feed of Food Waste

Figure 4:
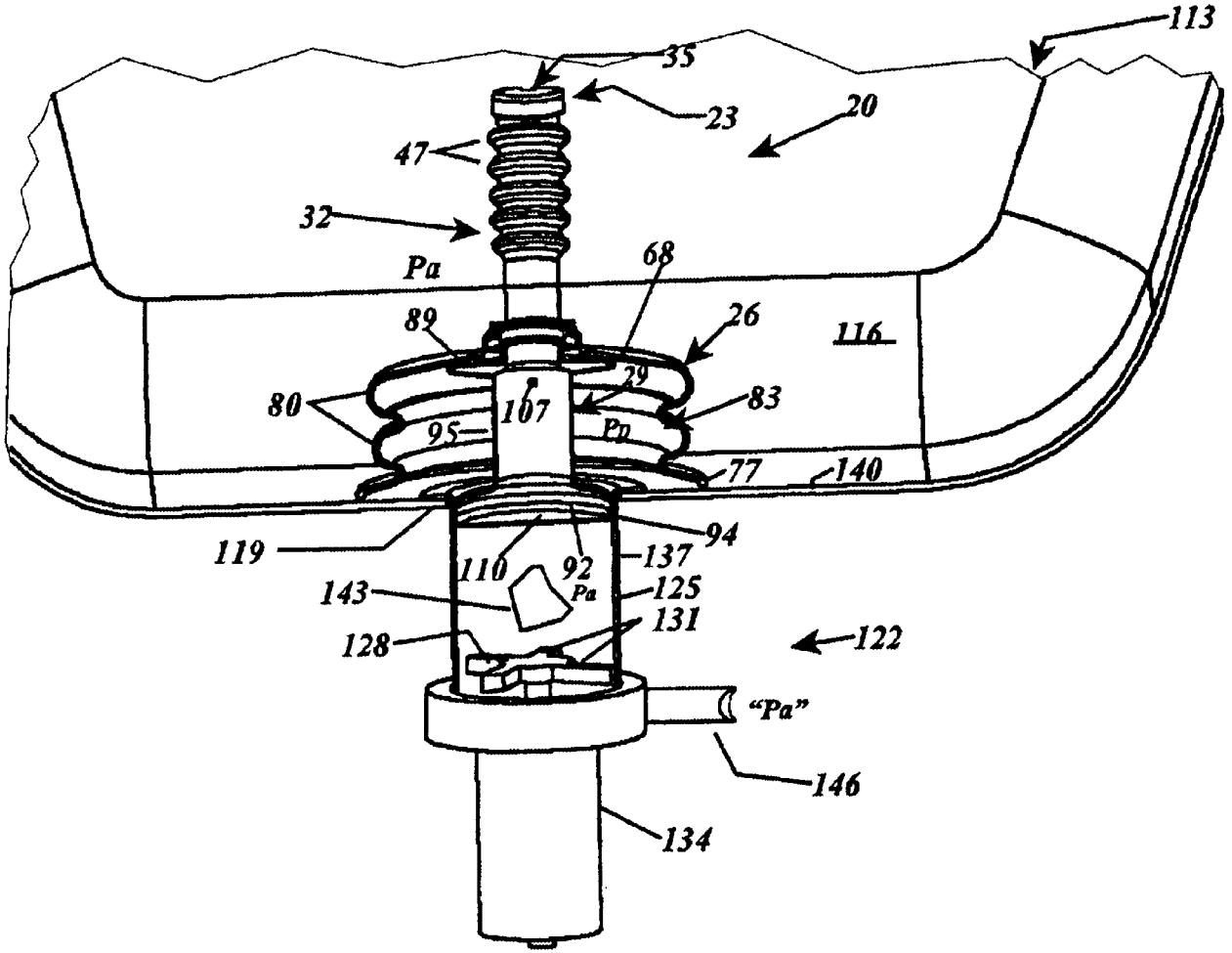
FIG. 4 is substantially a partial longitudinal sectional view of the waste disposal assist tool as assembled in a first operative position to the bowl of a kitchen sink with attached garbage disposer also shown in partial longitudinal section.

Referring to FIG. 4, the waste disposal assist tool 20 is shown in an upermost operative position as used in a standard kitchen sink 113 having a stainless steel bowl 116 with a drain hole 119, and a garbage disposer 122. The garbage disposer 122 includes a cylindrical housing 125 affixed at the drain hole 119. and a rotatable chopping disk 128 having a plurality of blades 131, the chopping disk 128 being driven by an electric motor 134. The waste disposal assist tool 20 fits coaxially with the drain hole 119 and the housing 125, the plunger 92 sealingly engaging an inner surface 137 of housing 125. Rim 77 of the plunger 26 sealingly engages a flat inner surface 140 of the bowl 116, with food waste 143 to be ground up by the blades 131 and disposed of through a drain pipe 146 disposed below the piston 92. In such first operative position, the relative pressures "Pa" (ambient pressure), "Pp" (pressure in the plunging chamber 83), "Ph" (pressure in the housing 125), and "Ps" (pressure of the liquid soap in the respective handle and piston member reservoirs 56 and 104) are about equal.

Figure 5:
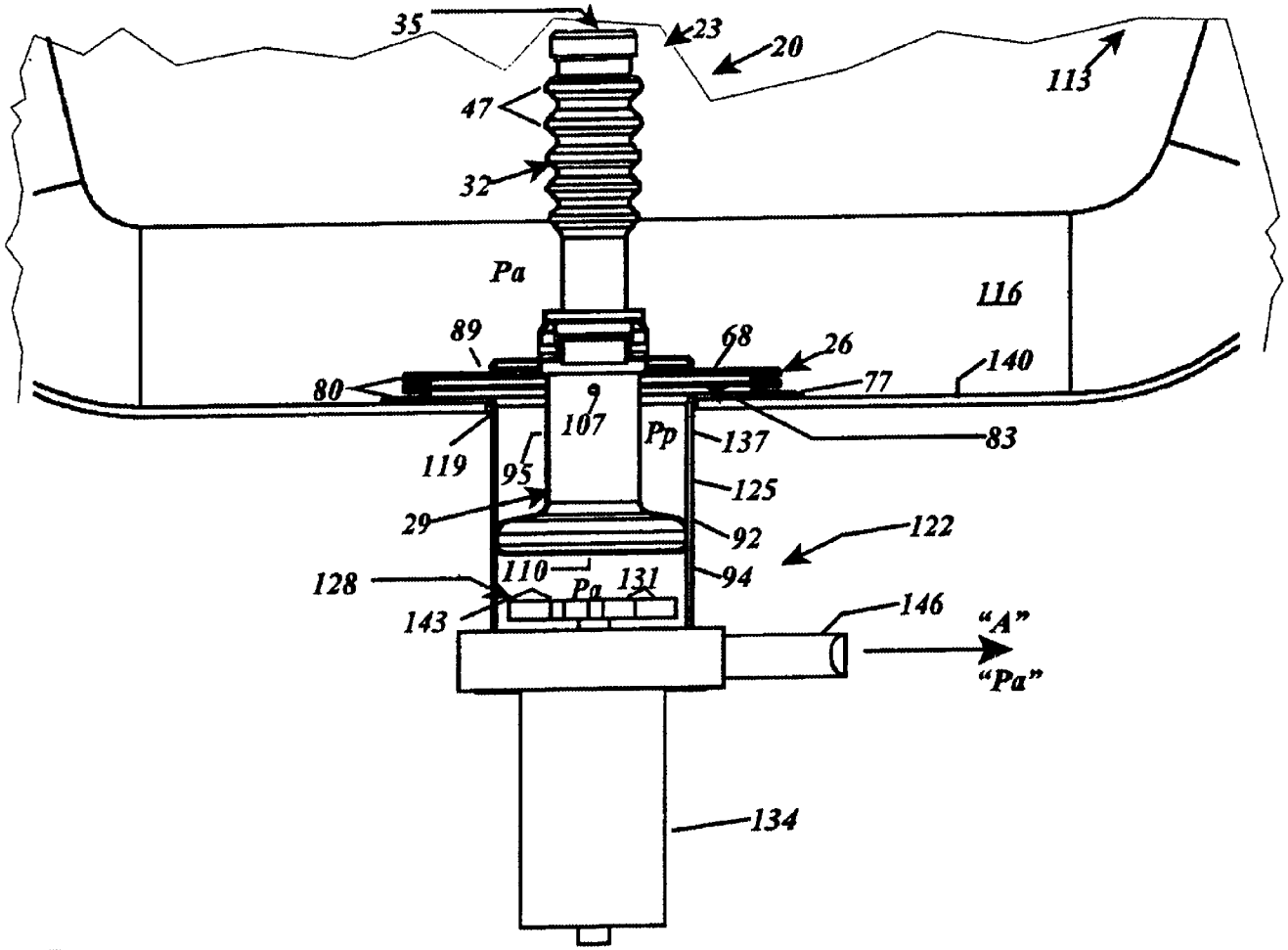
FIG. 5 is substantially a partial longitudinal sectional view corresponding to FIG. 4, but with the waste disposal assist tool shown in a second operative position.
Figure 6:
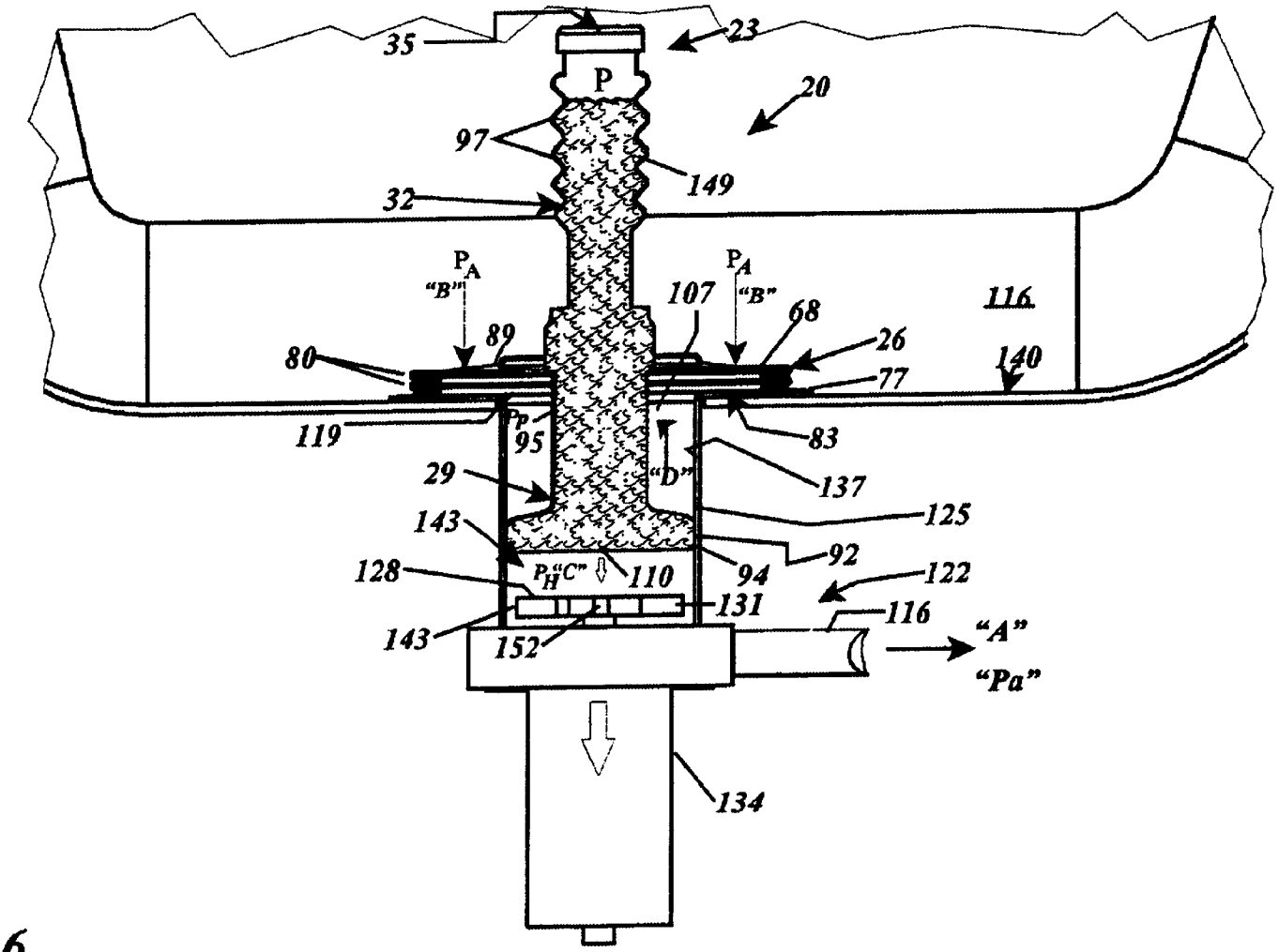
FIG. 6 is substantially a partial longitudinal sectional view corresponding to FIG. 5, but showing the flows of the liquid soap and pressure compensating air.

Referring to FIGS. 5 and 6, the waste disposal assist tool 20 is shown in a lowermost operative position wherein the garbage disposer has been turned on such that the food waste 143 is caused to be rotated in the direction of the blades 131, ground up, and thrown outwardly by centrifugal force along with the flushing water (not shown) originally contained within the housing 125 to exit through the drain pipe 146 as shown at arrow "A" to the household plumbing (not shown). The flushing water and finely ground food waste form a seal between the pressure "Ph" within the housing 125 and the ambient pressure "Pa" in the drain pipe 146. Therefore, the exiting of the food waste 143 and flushing water causes the pressure "Ph" within the housing 125 to drop slightly below the ambient pressure "Pa". The ambient air pressure "Pa" pushing downwardly against the disk 69 of the plunger 26 causes downward movement thereof as shown at arrows "B" and forces upper flange 89 of the piston member 29 downwardly. This action pushes the food waste 143 downwardly against the rotating blades 131 to automatically feed the food waste 143 without the need for manual force to be applied by a user. The process continues as more of the food waste 143 is ground up and exits through the drain pipe 146 until the piston 92 is in a lowermost position with the bellows 80 fully collapsed as shown in the FIGS. 5 and 6. Note that the piston 92 is prevented from further movement and from contacting the rotating blades 131 by the bellows 80 being fully collapsed against the inner surface 140 of the bowl 116.

Automatic Spraying of Soap

Again referring to FIGS. 4–6, liquid soap 149 is contained within the respective handle and piston member reservoirs 56 and 104, being introduced thereinto by unscrewing the screw cap 35. The liquid soap 149 is introduced through the soap outlet pin hole 110 into the housing 125 of the garbage disposer 122 as a spray 152 as shown at the arrow "C" by the pressure differential between the pressures "Pp", "Ps", and "Ph" caused during the automatic feed of the food waste 143. The pressure in the plunging chamber 83 "Pp" increases slightly over the ambient pressure "Pa" as the bellows 80 compress as shown by the arrows "B" whereas the pressure in the housing "Ph" is lower than "Pp", which air to enter the reservoir 104 of the piston member 29 through the air inlet pinhole 107 as shown at arrow "D" raising the pressure "Ps" such that the liquid soap 149 continues the spray 152 out of the soap outlet pinhole 110 in an attempt to raise the pressure in the housing "Ph". However, so long as there is soap 149 remaining and the garbage disposer 122 continues to grind and expel the food waste 143 into the drain pipe 146, the pressure differential will cause the spray 152 to continue. When the pressures "Pp", "Ps", and "Ph" equalize such as after the garbage disposer 122 is turned off, then the spray 152 of the liquid soap 149 ceases. The total amount and the rate of spray of the soap can be controlled by the design of the tool 20 including the relative diameters of the plunger 26, the air inlet pin hole 107, and the soap outlet pin hole 110.

Manual Spraying of Liquid Soap

The liquid soap 149 can also be sprayed through the soap outlet pin hole 110 by manually compressing the bellows 47 of the handle 32. This is useful for adding extra liquid soap into the garbage disposer 122 and for use while washing dishes following disposal of the food waste 143.

CONCLUSION

It can now be seen that the present invention solves many of the problems associated with the prior art. The present invention provides a tool that utilizes the slight vacuum created by a garbage disposer while grinding and disposing food waste to automatically feed the food waste contained within the garbage disposer to the rotating blades for grinding. The present invention provides a tool that stores liquid soap and automatically sprays a predetermined amount of the liquid soap into the garbage disposer while feeding the waste food. The present invention provides a tool that can act as a conventional plunger to unclog the garbage disposer and the drain pipe connected thereto. The present invention provides a tool that can spray liquid soap independently of feeding food waste by compressing the bellows of the handle. The present invention provides a tool that has a modular design wherein the handle, the piston member, and the plunger can be designed to fit the particular garbage disposer application.

Although the description above contains many specifications, these should not be construed as limiting the scope of the invention but as merely providing illustrations of some of presently preferred embodiments of this invention. The specification, for instance, makes reference to a round or circular cross-section for the handle, the plunger, and the piston. However, the present invention is not intended to be limited to only circular cross-sections. Rather it is intended that the present invention can have any cross-section or other such configuration which accomplishes the functions of the tool. Likewise, while a three piece with a separate handle, plunger, and piston member which threadably connect together is preferred, the present invention can be a unitary piece, two piece, or any number of pieces. Likewise, the closure of the handle can be a pressfit plug or other such device which retains the liquid soap therein. Also, while the present invention can be used to automatically feed the food waste in garbage disposers which have a housing with a cylindrical inner surface which is the same diameter or greater than the drain opening, the invention can be adapted for use with other types of garbage disposers which have smaller drain openings. Finally, while manual and automatic soap dispensing are preferred, the invention need not have such features. Thus, the scope of the invention should be determined by the appended claims and their legal equivalents rather than by the examples given.

What is claimed is:

1. A waste disposal assist tool for use in pushing food waste through the drain hole of a sink and through the housing of a sink-mounted garbage disposer having a plurality of rotatable blades to chop the food waste into particles and deposit them into a waste drain pipe, comprising:

a resilient plunger having an annular top portion and a downwardly dependent annular side wall terminating in an annular rim adapted to fit and seal around the drain hole of the sink above the garbage disposer, said top portion and side wall defining a plunging chamber;

a handle secured to a top of said top portion, said handle extending vertically upwardly from said plunger and adapted for being grasped and manipulated manually in-hand;

said handle is substantially hollow having a thin resilient wall enclosing an inner chamber for containing liquid soap;

said inner chamber having means for being fillable through a soap fill opening which is coverable by a closure to prevent the exiting of soap through said opening;

a piston member of round cross-section secured to said handle and to a bottom of said portion, said piston extending vertically downwardly from said plunger opposite said handle;

said piston having a soap conduit in communication with said inner chamber which terminates at a soap outlet opening of said piston, wherein a desired quantity of the liquid soap can be dispensed through said conduit and expelled through said soap outlet opening by manually deforming said handle;

said piston member is substantially hollow having a thin resilient wall enclosing an inner chamber which comprises the conduit also for containing liquid soap, said inner chambers of said handle and said piston member comprising one large chamber to contain the liquid soap;

soap outlet opening communicating with said larger inner chamber to expel soap when said handle is manually deformed;

said piston member comprises a piston of round cross-section and having an outer circumference, and a coaxial stem of smaller cross-section so as to radially fit within said outer circumference of said piston;

said stem having an air inlet hole;

said stem being secured to the handle at a first end thereof and having a second end to which said piston is affixed, said outer circumference of said piston member being of such a size as to closely fit to an inner surface of the housing of the garbage disposer for use with garbage disposers having a housing of the same or a larger inner diameter than the drain hole of the sink to sealingly engage the inner surface of the garbage disposer to form a substantially airtight seal thereagainst, wherein when the garbage disposer is activated, below ambient air pressure is created by the plurality of rotatable blades chopping the food waste into particles and depositing them into the waste drain pipe, pushing the waste food against the rotatable blades in an automatic feed fashion such that ambient air pressure above said bellows forces said piston member downward towards said rotatable blades creating a pressure between said bellows and said piston member which is higher than that below the soap outlet opening such that air enters the inner chamber and forces liquid soap to be expelled from the soap outlet opening into the housing of the garbage disposer; and wherein said piston is of a size for inserting through the drain hole of the sink and into the garbage disposer so as to reach most of the volume enclosed within the housing of the garbage disposer when said plunger is compressed against the sink coaxially about the drain hole by manually pushing downwardly on said handle, said piston being adapted for urging food waste through the drain hole and the housing of the garbage disposer for chopping into particles against the plurality of rotatable blades and depositing the particles into the waste drain pipe, and wherein said plunger is adapted for plunging to alternately create a pressure above and below ambient to unclog the garbage disposer and the drain pipe.

2. The tool of claim 1, wherein at least a portion of the piston member extends longitudinally beyond the annular rim of the plunger to guide the piston into the drain hole.

3. The tool of claim 1, wherein the outer circumference of the piston sealingly engages the inner surface of the garbage disposer using a resilient ring which is operatively connected to said piston at said outer circumference thereof.

4. The tool of claim 3, wherein the piston includes an annular groove at the outer circumference in which the resilient ring is disposed to be operatively connected to the piston.

5. The tool of claim 1, wherein the annular side wall of the plunger comprises a bellows.

6. The tool of claim 5, wherein at least a portion of the piston member extends longitudinally beyond the annular rim of the plunger to guide the piston into the drain hole, and wherein the soap outlet opening is disposed at a distal end of said piston member from said plunger generally on a longitudinal centerline of said piston.

7. The tool of claim 6, wherein the handle, the plunger, and the piston member are separate pieces, the annular top portion of said plunger having a central hole through which respective portions of said handle and said piston member extend to connect together, said upper portion of said plunger being retained between respective flanges of said handle and said piston member.

8. The tool of claim 7, wherein the handle and the respective portions of the handle and the piston member are threaded with respective mating male and female threads so as to threadably connect together.

9. The tool of claim 8, wherein the closure comprises a screw cap, the handle having a distal end from the plunger through which the soap fill opening extends and having mating threads to threadably engage said screw cap to close said soap fill opening, said handle which includes bellows which can be manually deformed by compressing together to dispense the liquid soap, said handle including said bellows being of generally round cross-section.

* * * * *